US009902591B2

(12) United States Patent
Parkkinen et al.

(10) Patent No.: US 9,902,591 B2
(45) Date of Patent: Feb. 27, 2018

(54) METHOD FOR GIVING DESTINATION CALLS IN AN ELEVATOR SYSTEM AND AN ELEVATOR SYSTEM

(71) Applicant: KONE Corporation, Helsinki (FI)

(72) Inventors: Jarmo Parkkinen, Espoo (FI); Jussi Hiltunen, Helsinki (FI); Kim Bergman, Helsinki (FI)

(73) Assignee: KONE CORPORATION, Helsinki (FI)

( * ) Notice: Subject to any disclaimer, the term of this patent is extended or adjusted under 35 U.S.C. 154(b) by 454 days.

(21) Appl. No.: 14/631,437

(22) Filed: Feb. 25, 2015

(65) Prior Publication Data

US 2015/0166302 A1 Jun. 18, 2015

Related U.S. Application Data

(63) Continuation of application No. PCT/FI2013/050904, filed on Sep. 24, 2013.

(30) Foreign Application Priority Data

Sep. 26, 2012 (FI) ..... 20126006

(51) Int. Cl.

| | |
|---|---|
| ***B66B 1/20*** | (2006.01) |
| ***B66B 1/24*** | (2006.01) |
| ***B66B 1/46*** | (2006.01) |
| ***B66B 1/34*** | (2006.01) |

(52) U.S. Cl.

CPC ..... *B66B 1/2458* (2013.01); *B66B 1/2408* (2013.01); *B66B 1/3407* (2013.01); *B66B 1/3446* (2013.01); *B66B 1/468* (2013.01); *B66B 2201/463* (2013.01); *B66B 2201/4615* (2013.01); *B66B 2201/4676* (2013.01)

(58) Field of Classification Search

CPC ... B66B 1/2458; B66B 1/2408; B66B 1/3407; B66B 1/3446; B66B 1/468; B66B 3/002; B66B 2201/4615; B66B 2201/4676; B66B 2201/463

USPC ..... 187/247, 380–389, 391, 393, 395, 396, 187/392

See application file for complete search history.

(56) References Cited

U.S. PATENT DOCUMENTS

| | | | | |
|---|---|---|---|---|
| 4,836,336 | A * | 6/1989 | Schroder | B66B 1/2458 187/384 |
| 6,902,041 | B2 * | 6/2005 | Eccleston | B66B 1/463 187/380 |
| 7,398,865 | B2 * | 7/2008 | Felder | B66B 1/463 187/395 |
| 8,136,636 | B2 * | 3/2012 | Bahjat | B66B 1/463 187/391 |

(Continued)

FOREIGN PATENT DOCUMENTS

| | | |
|---|---|---|
| CN | 1426951 A | 7/2003 |
| CN | 1973302 A | 5/2007 |

(Continued)

*Primary Examiner* — Anthony Salata
(74) *Attorney, Agent, or Firm* — Birch, Stewart, Kolasch & Birch, LLP

(57) ABSTRACT

A method for giving destination calls to an elevator system using a destination operating panel that includes a keypad for giving the destination calls, including identifying a call giving phase and activating buttons of the keypad on the basis of the call giving phase.

19 Claims, 6 Drawing Sheets

(56) References Cited

U.S. PATENT DOCUMENTS

Figure 1:
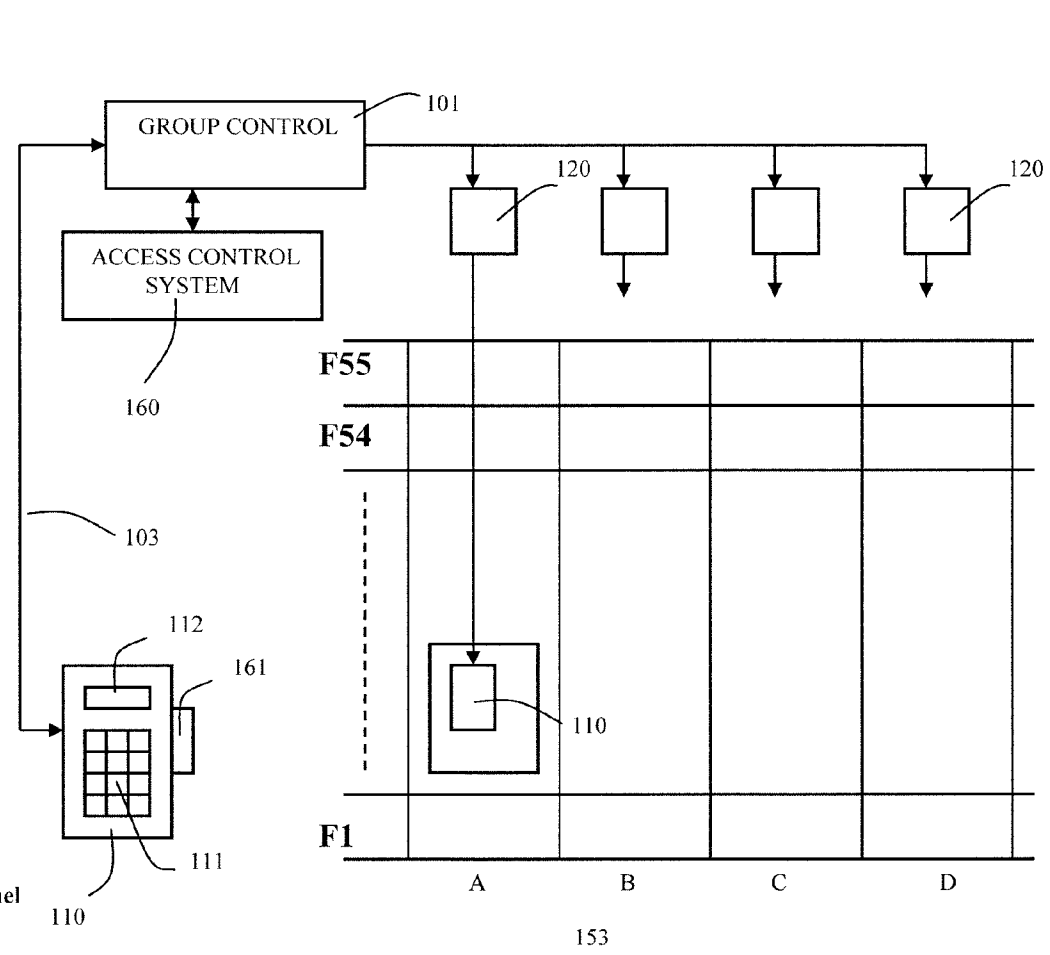

| | | | | |
|---|---|---|---|---|
| 8,584,810 | B2 * | 11/2013 | Tokura | B66B 1/2458 187/382 |
| 8,584,813 | B2 * | 11/2013 | Talonen | B66B 1/468 187/391 |
| 8,763,762 | B2 * | 7/2014 | Finschi | B66B 1/468 187/391 |
| 8,800,723 | B2 * | 8/2014 | De Jong | B66B 1/2458 187/388 |
| 8,910,752 | B2 * | 12/2014 | Furutani | B66B 1/468 187/384 |
| 9,561,931 | B2 * | 2/2017 | Kauppinen | B66B 1/468 |
| 2003/0111299 | A1 | 6/2003 | Han et al. | |
| 2003/0234597 | A1 | 12/2003 | Rosenberg | |
| 2004/0047297 | A1 | 3/2004 | Wynn | |
| 2015/0246790 | A1 * | 9/2015 | Hiltunen | B66B 1/461 187/382 |

FOREIGN PATENT DOCUMENTS

| | | | | |
|---|---|---|---|---|
| CN | 102791599 | A | 11/2012 | |
| EP | 1864933 | A1 * | 12/2007 | B66B 1/462 |
| WO | WO 2006/011876 | A1 | 2/2006 | |
| WO | WO 2011/101539 | A1 | 8/2011 | |

* cited by examiner

1 - elevator system
101 - group control of the elevator system
103 - data transfer channel
110 - destination operating panel
111 - decimal numeric keypad
112 - display
120 - elevator-specific control
160 - access control system
161 - reader device

METHOD FOR GIVING DESTINATION CALLS IN AN ELEVATOR SYSTEM AND AN ELEVATOR SYSTEM

FIELD OF THE INVENTION

The invention relates to elevator systems. More particularly the invention relates to the adaptive control of a call-giving device that is in connection with an elevator system.

BACKGROUND OF THE INVENTION

Passengers using elevators can give calls to elevators either in elevator cars and/or in an elevator lobby. Elevator lobbies are typically provided with up/down pushbuttons, by means of which a passenger can order an elevator to the call floor and simultaneously indicate his/her travel direction. After the elevator has arrived at the call-giving floor, the passenger moves into the elevator car and indicates his/her destination floor with the pushbuttons of the car panel in the elevator car. To a constantly increasing extent so-called destination call systems are used in high-rise buildings, in which systems a passenger indicates his/her destination floor already in the elevator lobby before going into the elevator car. For giving destination calls the elevator lobbies are provided with destination operating panels.

Destination operating panels are generally provided with a so-called decimal numeric keypad and a display means. If a passenger is going e.g. to floor 24, he/she keys into the decimal numeric keypad first the number 2 and then the number 4. The destination operating panel sends the data about the call-giving floor and about the aforementioned floor 24 to the control system of the elevator system. The control system allocates the optimal elevator for the use of the passenger and transmits information about this to the call-giving panel, to the display means, on which appears e.g. the text "Elevator B".

Since a decimal numeric keypad enables, in principle, the keying in of any floor number whatsoever, this easily results in erroneous keyings. A passenger can, for example, key in a destination call to a floor that the elevator system does not serve or the floor is temporarily locked. It is also possible that there is an access control system in use in the building, with which system the access of passengers to floors within the scope of the access control can be limited.

AIM OF THE INVENTION

The aim of the present invention is to eliminate or at least to alleviate the aforementioned drawbacks that occur in prior-art solutions. The aim of the invention is also to achieve one or more of the following objectives:

to facilitate and speed up call-giving, and to reduce erroneous calls

SUMMARY OF THE INVENTION

The method according to the invention is characterized by what is disclosed in the characterization part of claim 1. The elevator system according to the invention is characterized by what is disclosed in the characterization part of the claim. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

According to a first aspect of the present invention an elevator system is presented, which comprises a destination operating panel, which comprises a decimal numeric keypad for giving destination calls to an elevator system. According to the invention the call-giving phase is identified, and, of the buttons of the decimal numeric keypad, the buttons according to the call-giving phase are activated, and the activated buttons are indicated with signaling that differs from the de-activated buttons. A destination operating panel can be either in an elevator lobby or in an elevator car. The signaling can be e.g. button-specific visual signaling and/or signaling based on button vibration. The first phase of the call-giving starts from when the previous call-giving has ended and the destination operating panel is ready to receive the next call. The next phase starts always when a passenger presses an activated button.

In one embodiment of the invention the call-giving panel comprises a touch-sensitive display in connection with the decimal numeric keypad. On the touch-sensitive display the buttons activated at any given time can be shown and the de-activated buttons can be hidden or dimmed (visual signaling).

In one embodiment of the invention the passenger is identified in connection with call-giving a call and the aforementioned identification data is taken into account when activating buttons in the different stages of the call-giving.

In one embodiment of the invention one or more floors of the floors served by the elevator system are temporarily locked and the aforementioned lockings are taken into account when activating buttons in the different stages of the call-giving.

In one embodiment of the invention a personal terminal apparatus in the use of a passenger, e.g. a mobile phone provided with a touch-sensitive display, functions as a destination operating panel.

In one embodiment of the invention the control system and/or the access control system sends to the destination operating panel information about the activated buttons. The destination operating panel can comprise a memory means, in which information about the activated buttons is stored.

With the solution according to the invention numerous advantages are achieved compared to prior-art solutions. One advantage, among others, of the present invention is that the number of erroneous keyings given by passengers in connection with call-giving can be reduced. The destination operating panel according to the invention can be adapted to different situations such as e.g. to situations in which one or more floors are locked temporarily or a passenger does not have an access right to all the floors served by the elevator system. The solution according to the invention also speeds up and facilitates call-giving because a passenger has available in the different stages of call-giving the minimum number of "permitted" buttons.

LIST OF FIGURES

Figure 2:
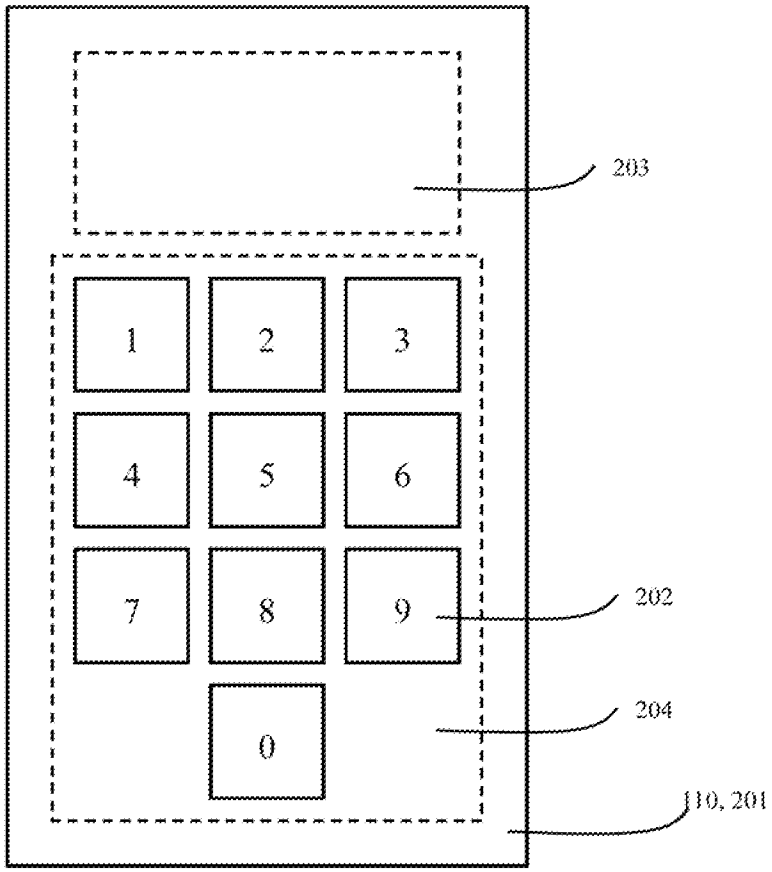

In the following, the invention will be described in detail by the aid of a few examples of its embodiments, wherein:

FIG. 1 presents an elevator group according to the invention;

FIG. 2 presents a destination operating panel, which is implemented with a touch-sensitive display; and FIGS. 2*a*-2*e* present destination operating panels in various states according to the present invention.

DETAILED DESCRIPTION OF THE INVENTION

FIG. 1 presents an elevator system 1 according to the invention, which comprises four elevators A, B, C and D as well as a group control 101 of the elevator system and also an elevator-specific control 120. The elevators serve the floors 1-55 (F1-F55) in the building. A destination operating panel 110 is connected via a data transfer channel 103 to the control system 101, which destination operating panel is disposed e.g. in the entrance lobby of the building. The data transfer channel can be any wireless or wireline data transfer channel whatsoever suited to the purpose. The destination operating panel comprises a decimal numeric keypad 111, a display 112 and a reader device 161 for the access cards in the possession of passengers. The server 160 of an access control system is in connection with the control system 101, which server receives from a reader device 161 the data contained in the access cards and determines on the basis of the aforementioned data the access rights of a passenger in the building. Information about the floors to which a passenger has an access right is transmitted from the server 160 to the control system 101 and onwards to the destination operating panel 110.

Figure 2A:
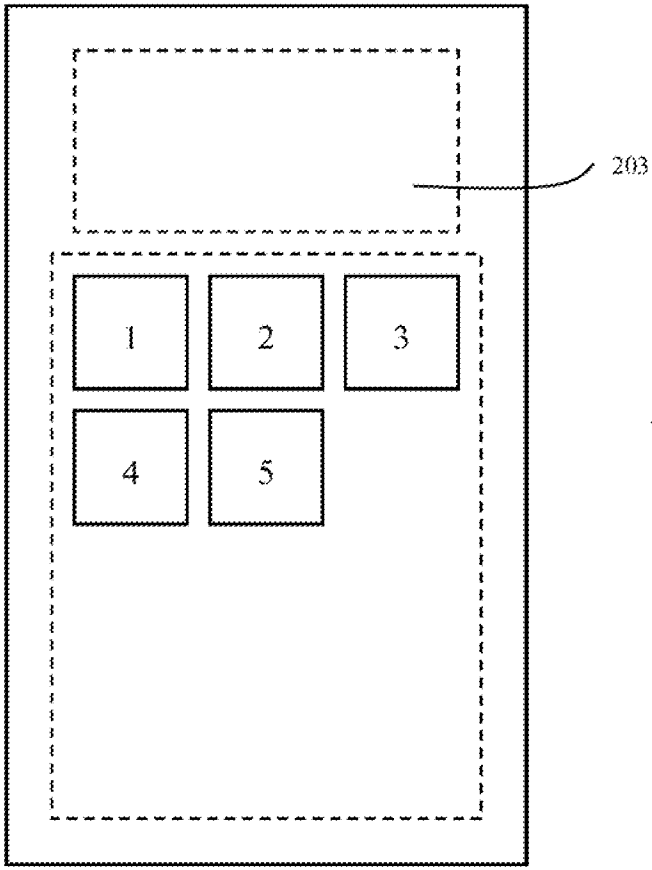
Figure 2B:
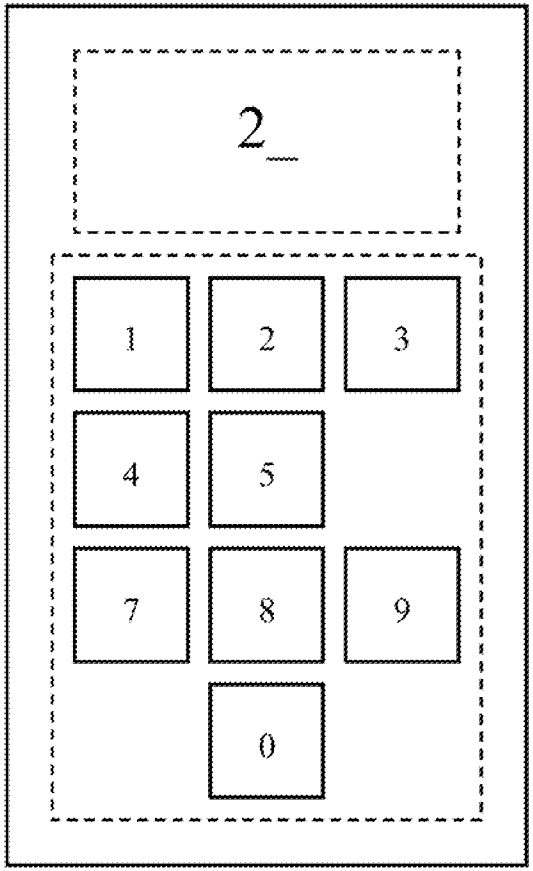

FIG. 2 presents a destination operating panel 110, which is implemented with a touch-sensitive display 201. The decimal numeric keypad 204 comprises buttons 202 (soft-touch buttons 0, 1, . . . 9) and a display area 203, in which information can be shown to a person giving a call. The active and non-active buttons of the decimal numeric keypad 204 are distinguished from each other by showing the active buttons on the touch-sensitive display 201 and by fading out the non-active buttons. FIG. 2*a* presents a destination operating panel in the initial state, from which call-giving starts (phase 1). In the initial state the buttons 0, 1, 2, 3, 4 and 5 of the decimal numeric keypad are activated but the other buttons have faded out (de-activated). If a passenger is going e.g. to floor 23, at first he/she presses the button 2, in which case the number 2 appears in the display area 203 and all the buttons 0-9 of the decimal numeric keypad activate (phase 2). When the passenger after this presses the button 3, the number 23 appears in the display area. The destination operating panel sends to the control system 101 of the elevator system a destination call for taking the passenger from floor 1 to floor 23. The control system 101 allocates an elevator, e.g. elevator B, for use by the passenger, which is displayed in the display area 203, e.g. with the text "Floor 23—Elevator B". If in the example explained above e.g. floor 26 is a locked floor, which the elevators do not serve, in phase 2 all the other buttons 0-9 activate except the button 6 (FIG. 2*b*). A passenger cannot therefore give a destination call to the locked floor 26.

Figure 2C:
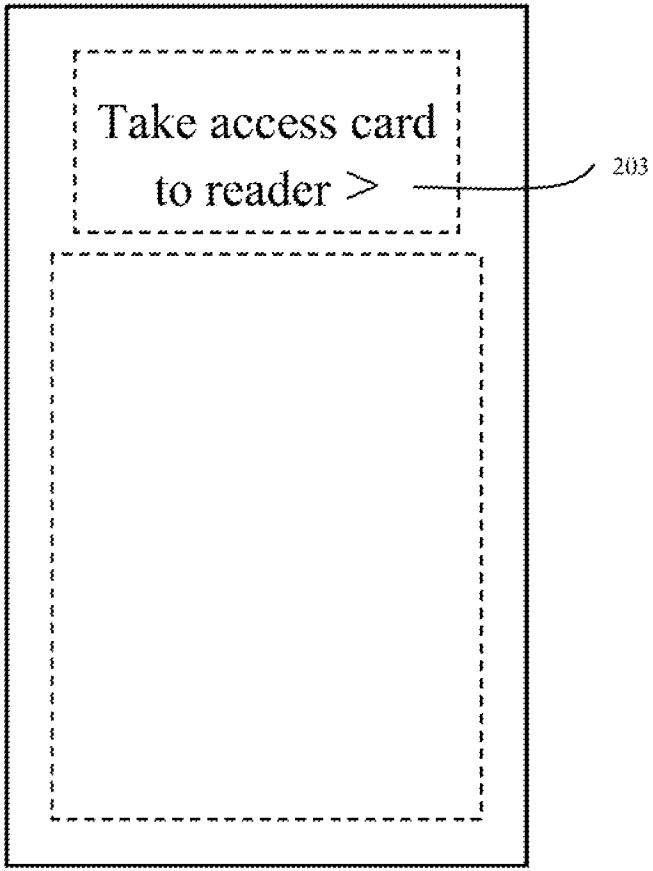
Figure 2E:
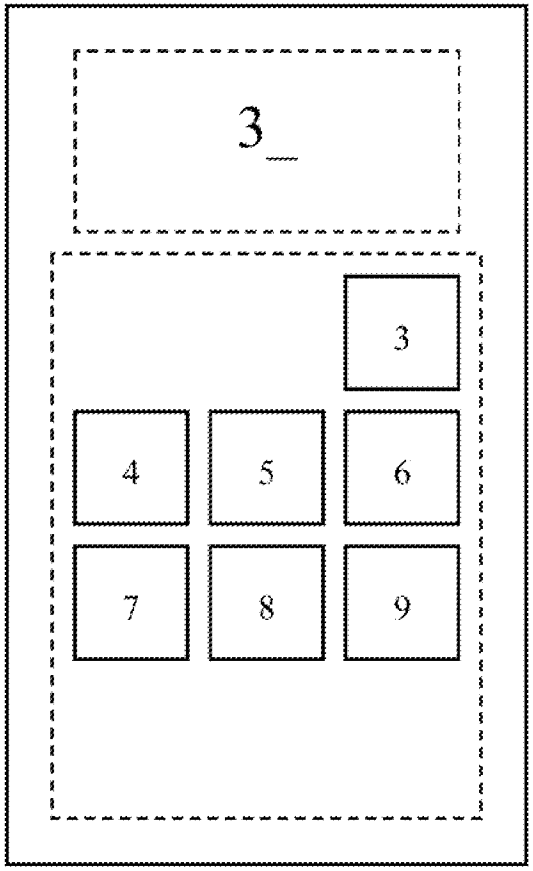
Figure 2D:
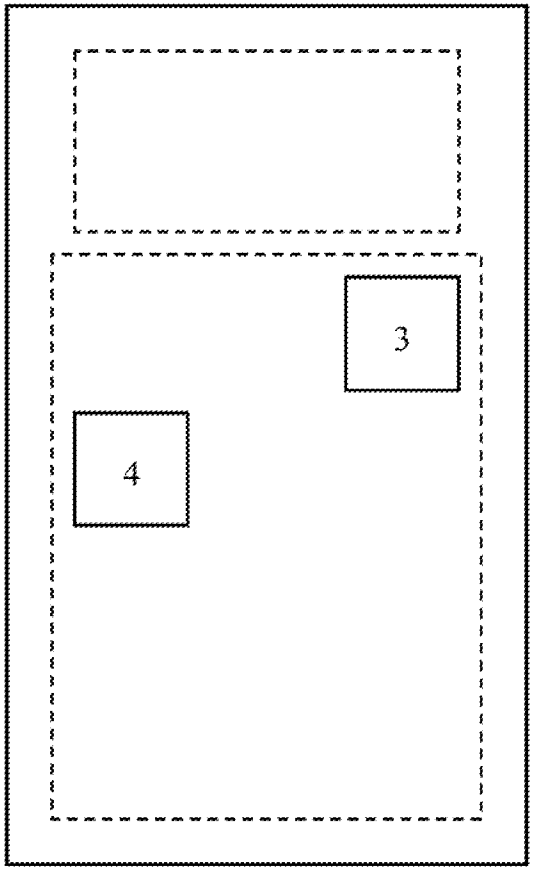

According to FIG. 1 the elevator system can be connected to an access control system 160, which allows the access of passengers to floors on the basis of access rights given to them. In this embodiment a passenger has been given e.g. an access card, which contains identification data (an ID number), on the basis of which the access control system determines the access rights of the passenger in the building, For reading access cards, the destination operating panel is provided with a reader device 161 suited to the purpose, which is connected directly or indirectly to the access control system 160. In this embodiment a passenger must present his/her access card to a reader device 161 before he/she can give destination calls from the destination operating panel 110. In the initial situation (phase 1) on the display of the destination operating panel is e.g. the text "Take access card to reader" and all the buttons of the decimal numeric keypad are de-activated (FIG. 2*c*). When a passenger, who has an access right e.g. to floors 33-41 takes his/her access card to the reader device, the numbers 3 and 4 in the decimal numeric keypad activate (phase 2, FIG. 2*d*). If the passenger presses the button 3, the buttons 3-9 activate (phase 3, FIG. 2*e*), in which case he/she can give a destination call to any of the floors 33-39. On the other hand, if the passenger presses the button 4 in phase 2, the buttons 0 and 1 activate, in which case the passenger can give a destination call either to floor 40 or to floor 41.

If a passenger has access rights differing from the preceding example, e.g. to floors 31-38, the elevator system can function as follows. When a passenger takes his/her access card to the reader device 161, the numbers 1-8 activate and the number 3 appears automatically in the display means (phase 2). In this embodiment the elevator system can "simulate" the pressing of the button 3 because the passenger has an access right only to floors 31-38. When the passenger presses e.g. the button 2, the destination operating panel sends to the control system of the elevator system a destination call to floor 32.

In the destination operating panels of the preceding embodiments, touch-sensitive displays are utilized. The solution according to the invention is not, however, limited only to touch-screen display technology but instead many other alternatives are possible. Thus, for example, the decimal numeric keypad of the destination operating panel can be implemented with conventional mechanical pushbuttons/buttons and active buttons can be indicated e.g. with button-specific background lights. The active buttons can also be indicated with button vibration when touching an active button. The aforementioned button vibration is suited for use in connection with both mechanical pushbuttons and touch-sensitive displays.

According to one embodiment of the invention a mobile phone in the use of a passenger, which is provided with e.g. a touch-sensitive display and application software for giving destination calls, functions as a destination operating panel. The elevator lobbies can be provided with e.g. Bluetooth base stations for implementing wireless data transfer between the aforementioned mobile phone and the control system 101.

It is obvious to the person skilled in the art that different embodiments of the invention are not limited to the example described above, but that they may be varied within the scope of the claims presented below.

The invention claimed is:

1. A method for giving destination calls to an elevator system by means of a destination operating panel in one or more call-giving phases, which destination operating panel comprises a decimal numeric keypad for giving destination calls, said method comprising the steps of:

identifying a passenger;

determining access rights of the passenger on the basis of the identification; and during the call-giving phase in which at least one input is applied to the decimal numeric keypad, continuously activating the buttons of the decimal numeric keypad the passenger has access rights to and continuously deactivating the buttons of the decimal numeric keypad the passenger does not have access rights to.

2. The method according to claim 1, wherein the activated buttons are indicated with signaling that differs from the de-activated buttons.

3. The method according to claim 1, further comprising the steps of:

identifying the locked floors of the elevator system; and taking the locked floors into account when determining the buttons of the decimal numeric keypad to be activated.

4. The method according to claim 2, further comprising the steps of:

identifying the locked floors of the elevator system; and taking the locked floors into account when determining the buttons of the decimal numeric keypad to be activated.

5. The method according to claim 1, wherein the destination operating panel automatically inputs a button of the decimal numeric keypad.

6. An elevator system, comprising:

at least one elevator;

at least one destination operating panel, which comprises a decimal numeric keypad for giving destination calls to the elevator system in one or more phases; and a control system that responds to the destination operating panel, wherein the elevator system is configured to:

identify a passenger;

determine access rights of the passenger on the basis of the identification; and during a call-giving phase in which at least one input is applied to the decimal numeric keypad, continuously activate the buttons of the decimal numeric keypad the passenger has access rights to and continuously deactivate the buttons of the decimal numeric keypad that the passenger does not have access rights to.

7. The elevator system according to claim 6, wherein the call-giving panel is arranged to present the activated buttons with signaling, which deviates from the signaling of the de-activated buttons.

8. The elevator system according to claim 7, wherein the signaling is button-specific visual signaling and/or signaling based on button vibration.

9. The elevator system according to claim 6, wherein the call-giving panel comprises a touch-sensitive display in connection with the decimal numeric keypad.

10. The elevator system according to claim 6, wherein the call-giving panel comprises a reader device for reading the data of an access card in the possession of a passenger and for transmitting said data to an access control system that is in connection with the elevator system.

11. The elevator system according to claim 6, wherein the destination operating panel is a personal terminal device in the possession of a passenger.

12. The elevator system according to claim 6, wherein the control system of the elevator system and/or the access control system is/are arranged to transmit to the destination operating panel information about the buttons of the decimal numeric keypad to be activated.

13. The elevator system according to claim 7, wherein the call-giving panel comprises a touch-sensitive display in connection with the decimal numeric keypad.

14. The elevator system according to claim 8, wherein the call-giving panel comprises a touch-sensitive display in connection with the decimal numeric keypad.

15. The elevator system according to claim 7, wherein the call-giving panel comprises a reader device for reading the data of an access card in the possession of a passenger and for transmitting said data to an access control system that is in connection with the elevator system.

16. The elevator system according to claim 8, wherein the call-giving panel comprises a reader device for reading the data of an access card in the possession of a passenger and for transmitting said data to an access control system that is in connection with the elevator system.

17. The elevator system according to claim 9, wherein the call-giving panel comprises a reader device for reading the data of an access card in the possession of a passenger and for transmitting said data to an access control system that is in connection with the elevator system.

18. The elevator system according to claim 7, wherein the destination operating panel is a personal terminal device in the possession of a passenger.

19. The elevator system according to claim 6, where the destination operating panel is configured to automatically input a button of the decimal numeric keypad.

* * * * *